US009449782B2

(12) United States Patent
Poquette et al.

(10) Patent No.: US 9,449,782 B2
(45) Date of Patent: Sep. 20, 2016

(54) X-RAY TUBE TARGET HAVING ENHANCED THERMAL PERFORMANCE AND METHOD OF MAKING SAME

(75) Inventors: Ben David Poquette, Wauwatosa, WI (US); Thomas Carson Tiearney, Jr., Waukesha, WI (US); Gregory Alan Steinlage, Hartland, WI (US); Michael Scott Hebert, Muskego, WI (US); Donald Robert Allen, Waukesha, WI (US); Christian Bennett Fuller, New Berlin, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 420 days.

(21) Appl. No.: 13/591,943

(22) Filed: Aug. 22, 2012

(65) Prior Publication Data

US 2014/0056404 A1 Feb. 27, 2014

(51) Int. Cl.
*H01J 35/10* (2006.01)

(52) U.S. Cl.
CPC ..... *H01J 35/105* (2013.01); *H01J 2235/084* (2013.01); *H01J 2235/1233* (2013.01); *H01J 2235/1291* (2013.01)

(58) Field of Classification Search
CPC ..... H01J 35/10; H01J 35/26; H01J 35/108; H01J 35/105; H01J 35/12; H01J 2235/1204; H01J 2235/084; H01J 2235/1291
USPC ..... 378/141, 143, 144
See application file for complete search history.

(56) References Cited

U.S. PATENT DOCUMENTS

| | | | | |
|---|---|---|---|---|
| 3,959,685 | A | 5/1976 | Konieczynski | |
| 3,969,131 | A * | 7/1976 | Fatzer | C04B 38/00 313/345 |
| 4,271,372 | A * | 6/1981 | Geldner | H01J 35/108 378/127 |
| 4,344,012 | A * | 8/1982 | Hubner | H01J 35/108 313/311 |
| 4,392,238 | A * | 7/1983 | Lersmacher | H01J 35/108 313/311 |
| 4,625,324 | A * | 11/1986 | Blaskis | H01J 35/16 313/22 |
| 5,414,748 | A * | 5/1995 | Upadhya | H01J 35/105 378/127 |
| 6,033,506 | A * | 3/2000 | Klett | C04B 38/00 156/245 |
| 6,078,644 | A * | 6/2000 | Day | H01J 35/108 378/143 |

(Continued)

OTHER PUBLICATIONS

Bentor, Yinon. Chemical Element.com—Copper. Dec. 15, 2014 <http://www.chemicalelements.com/elements/cu.html>.*

(Continued)

*Primary Examiner* — Wyatt Stoffa
(74) *Attorney, Agent, or Firm* — GE Global Patent Operation; Marc A. Vivenzio

(57) ABSTRACT

An x-ray tube includes a frame enclosing a high vacuum, a cathode positioned within the enclosure, and a target assembly. The target assembly includes a target cap, a focal track material positioned on the target cap to receive electrons from the cathode, and a foam material positioned within a cavity of the target cap and positioned proximate the focal track. The x-ray tube also includes a bearing assembly attached to the frame and configured to support the target assembly.

15 Claims, 6 Drawing Sheets

(56) References Cited

U.S. PATENT DOCUMENTS

| | | | | |
|---|---|---|---|---|
| 6,287,375 | B1 * | 9/2001 | Klett | C04B 38/0022 106/122 |
| 7,369,646 | B2 * | 5/2008 | Dittrich | H01J 35/16 378/130 |
| 7,382,863 | B2 * | 6/2008 | Parampil | H01J 35/106 378/130 |
| 7,406,156 | B2 * | 7/2008 | Lenz | H01J 35/105 378/127 |
| 7,561,669 | B2 * | 7/2009 | Thangamani | H01J 35/10 378/127 |
| 8,243,884 | B2 * | 8/2012 | Rodhammer | C22C 26/00 378/119 |
| 2003/0162007 | A1 * | 8/2003 | Klett | C04B 35/521 428/304.4 |
| 2004/0013234 | A1 * | 1/2004 | Kutschera | H01J 35/105 378/144 |
| 2007/0195934 | A1 * | 8/2007 | Weiss | C04B 35/522 378/144 |
| 2008/0199390 | A1 * | 8/2008 | Stansberry | C04B 38/0022 423/448 |
| 2010/0284520 | A1 * | 11/2010 | Reis | H01J 35/108 378/144 |
| 2010/0316193 | A1 * | 12/2010 | Rodhammer | C22C 26/00 378/143 |
| 2011/0007877 | A1 * | 1/2011 | Legall | H01J 35/101 378/141 |
| 2012/0099703 | A1 * | 4/2012 | Kraft | H01J 35/105 378/62 |
| 2012/0213325 | A1 * | 8/2012 | Pietig | H01J 35/105 378/4 |

OTHER PUBLICATIONS

Klett, J., et al., "High-thermal-conductivity, mesophase-pitch-derived carbon foams: effects of precursor on structure and properties" Carbon 38 (2000) 953-973.*

Gomez, "High-Temperature Phase Change Materials (PCM) Candidates for Thermal Energy Storage (TES) Applications," National Renewable Energy Laboratory, Milestone Report, Sep. 2011, pp. iii-31.

* cited by examiner

X-RAY TUBE TARGET HAVING ENHANCED THERMAL PERFORMANCE AND METHOD OF MAKING SAME

BACKGROUND OF THE INVENTION

The invention relates generally to x-ray tubes and, more particularly, to an apparatus for improving heat transfer characteristics in an x-ray tube and a method of making same.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, it is typically necessary to rotate the anode assembly at high rotational speed.

Because of the inefficiency of creating x-rays from the focused electron beam, a significant amount of waste heat is generated at the focal spot. One of the major problems in designing and operating an x-ray tube is finding the means to generate the desired amount of x-rays while also removing the waste heat from the focal spot. Typically the peak operating temperature of the focal spot is the limiting factor that dictates the peak power that can be applied at the focal spot. The limiting factor of the focal spot is based on the maximum material temperatures that can be sustained at the focal spot while taking focal track life into consideration. In addition, peak average temperature of the target assembly is also taken into account and can be a limiting factor in operating the x-ray tube, as well. The peak average temperature of the target assembly is dictated by such factors as average overall power, material properties (heat capacity, thermal conductivity, etc. . . . ), and the amount of heat transfer that occurs during operation.

The target assembly is operated in vacuum in order to enable a high voltage potential that can reach 140 keV or greater between the anode and the cathode. Thus, convection heat transfer is not a mode of heat transfer that is available to cool the target within an evacuated region of an x-ray tube. As known in the art bearings in an x-ray tube may include either roller bearings or a spiral groove bearing (SGB). Typically, the contact regions of the bearings are, from a thermal conduction perspective, well removed from the point of heat generation at the focal spot. That is, the conduction path from the focal spot typically includes, first off, passing from the outer radius of the target to the inner radius of the target, then through a thermal barrier, and then along a shaft of the bearing. Thus, regardless of whether the bearing is a roller bearing or an SGB, the conduction path tends to be relatively long and therefore little, if any, significant amount of conduction heat transfer occurs in the target assembly.

Because there is typically little cooling of the target assembly by both conduction and convection, the dominant mode of heat transfer of the target is therefore via radiation heat transfer to its surrounding environment. Thus, design and operation of an x-ray tube presents a daunting challenge, from a thermal perspective, because the dominant mode of heat transfer is by radiation, and because of the dual desire to 1) maximize peak power at the focal spot, and 2) maximize the average power applied to the target assembly.

As known in the art, the average power applied to a target assembly can be greatly increased by providing a light-weight heat storage material, such as graphite, to the back side of the target and approximately opposite the face of the focal track. Graphite has a very high thermal storage capacity and also a high emissivity, enabling a much greater average power to be applied than to a target alone without a heat storage material. However, because the target cap itself typically includes a material such as molybdenum having a relatively low thermal conductivity, and because of the very high localized power that is applied at the focal spot, significant thermal gradients tend to occur within the target cap. Such gradients occur whether the graphite heat storage medium is present or not. Thus, to first order the dual desire to 1) maximize peak power at the focal spot and 2) maximize the average power applied to the target assembly present thermal problems that are independent of one another.

Known solutions to improve the heat transfer performance of x-ray tube targets include the use of low melting temperature phase-change materials or the use of a diamond-metal composite. Such solutions, however, can introduce additional problems that can lead to early life failure, cost excessively in manufacture, and the like. For instance, one known solution includes adding 'slugs' of phase-change materials about the circumference of the target and opposite the focal track. Because the slugs heat and cool through a phase-change from solid to liquid, the slugs offer an increased amount of heat storage (relative to the target cap) due to transitioning through the melt temperature of the slug material, taking advantage of the heat of fusion of the slug material. The increased thermal capacity thereby increases the thermal storage of the target, enabling an increased average power to be deposited in the target.

The slugs are placed into a cavity and then sealed in order to prevent leakage during high-temperature operation. However, because of the phase-change that occurs, a volumetric change occurs as well, leading to many high-stress heating and cooling cycles over the life of the x-ray tube, which can lead to significant cycling in the joints used to seal the slugs. Such cycling and stress can lead to failure of the joint(s) that retain the slug(s), causing a loss of the phase-change material and a catastrophic loss of the x-ray tube.

Further, the slugs (whether in liquid or solid phase) typically may not substantially alter the thermal conductivity of the target. As such, substantial thermal gradients tend to occur in the target assembly. Thus, although a phase-change material within the target can increase the overall thermal capacity of the target, it does so at the expense of increased manufacturing cost, added modes of failure, and typically little or no reduction in the thermal gradients that can develop in the x-ray tube target.

Another known solution includes the use of diamond or a diamond-metal composite within the target and positioned under the focal track. Diamond is a material known for its high thermal conductivity. Thus, by introducing diamond or a diamond-based material into a target, thermal gradients may be reduced proximate the focal track providing an improved thermal path from the focal track to, for instance, the side of the target opposite that of the focal track.

However, in order to obtain the increased benefit of the high thermal conductivity material, a high quality bond between the target substrate and the high thermal conductivity material is relied upon. That is, if a poor thermal contact is formed between the material and the target substrate, a tremendous increase in focal spot temperature can result. Typically, diamond or diamond-based materials have a coefficient of thermal expansion (CTE) that is different from the target substrate (typically molybdenum) as well. Diamond-based materials also typically include high elastic moduli as well relative to the base target cap material. Thus, very high stresses can result in the bond joint due to the different CTEs and the high elastic moduli of the attached materials. The very high stresses can lead to bond joint failure, the propensity of which can be exacerbated from the many cycles that occur during the life of an x-ray tube.

In addition, it is commonly known in the art that diamond and diamond-based materials can be very expensive to fabricate and process. Diamond based composites typically consist of discontinuous diamond reinforcement within a matrix of another material. This provides an inefficient thermal path as the diamond particles are isolated and discontinuous within the matrix. Therefore, although diamond and diamond-based materials may provide improved thermal conduction proximate the focal spot and reduced temperature thereof at a given power, their implementation can be quite costly, while adding an additional risk in a new mode of failure.

As such, known solutions for improving thermal performance of x-ray tubes may result in improvement of one performance parameter (i.e., thermal gradient within the target or thermal capacity of the target assembly) while leaving the other parameter generally unaffected. Further, such known solutions typically include an increased material cost as well as an increased cost of manufacturing, while also adding additional failure modes to the x-ray tube.

Therefore, it would be desirable to design an x-ray tube having a target with an improved thermal performance that overcomes the aforementioned drawbacks.

BRIEF DESCRIPTION

The invention provides an apparatus for improving the heat transfer characteristics of an x-ray tube that overcomes the aforementioned drawbacks.

According to one aspect of the invention, an x-ray tube includes a frame enclosing a high vacuum, a cathode positioned within the enclosure, and a target assembly. The target assembly includes a target cap, a focal track material positioned on the target cap to receive electrons from the cathode, and a foam material positioned within a cavity of the target cap and positioned proximate the focal track. The x-ray tube also includes a bearing assembly attached to the frame and configured to support the target assembly.

In accordance with another aspect of the invention, a method of fabricating a target cap for an x-ray tube target assembly includes providing a target cap having a focal track material, forming a cavity in the target cap, and positioning a foam material within the cavity.

Yet another aspect of the invention includes an x-ray imaging system that includes a detector, positioned to receive x-rays that pass through an object and an x-ray source positioned to emit x-rays toward the object. The x-ray source includes an electron emitter and a target assembly. The target assembly includes a target cap, a focal track attached to the target cap and positioned to receive electrons from the electron emitter, a structural foam positioned within a hollow of the target cap that is positioned proximate the focal track, and a bearing assembly attached to a frame of the x-ray source and configured to support the target assembly.

Various other features and advantages of the invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
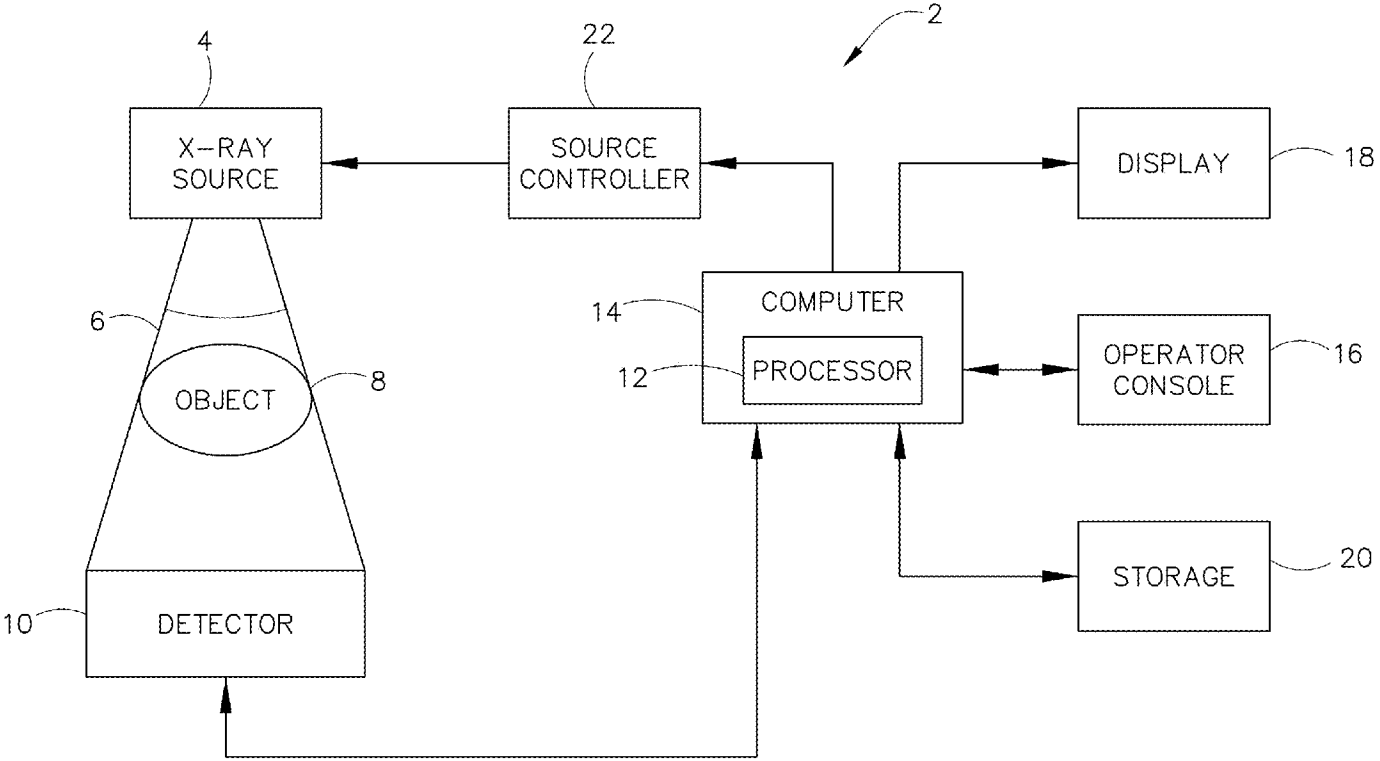
FIG. 1 is a block diagram of an imaging system that can benefit from incorporation of an embodiment of the invention.

FIG. 1 is a block diagram of an embodiment of an x-ray imaging system 2 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of imaging system 2 is merely an example of one such implementation and is not intended to be limiting in terms of modality.

As shown in FIG. 1, imaging system 2 includes an x-ray tube or source 4 configured to project a beam of x-rays 6 through an object 8. Object 8 may include a human subject, pieces of baggage, or other objects desired to be scanned. X-ray source 4 may be a conventional x-ray tube producing x-rays having a spectrum of energies that range, typically, from 30 keV to 200 keV. The x-rays 6 pass through object 8 and, after being attenuated by the object, impinge upon a detector 10. Each detector in detector 10 produces an analog electrical signal that represents the intensity of an impinging x-ray beam, and hence the attenuated beam, as it passes through the object 8. In one embodiment, detector 10 is a scintillation based detector, however, it is also envisioned that direct-conversion type detectors (e.g., CZT detectors, etc.) may also be implemented.

A processor 12 receives the signals from the detector 10 and generates an image corresponding to the object 8 being scanned. A computer 14 communicates with processor 12 to enable an operator, using operator console 16, to control the scanning parameters and to view the generated image. That is, operator console 16 includes some form of operator interface, such as a keyboard, mouse, voice activated controller, or any other suitable input apparatus that allows an operator to control the imaging system 2 and view the reconstructed image or other data from computer 14 on a display unit 18. Additionally, operator console 16 allows an operator to store the generated image in a storage device 20 which may include hard drives, flash memory, compact discs, etc. The operator may also use operator console 16 to provide commands and instructions to computer 14 for controlling a source controller 22 that provides power and timing signals to x-ray source 4.

Figure 2:
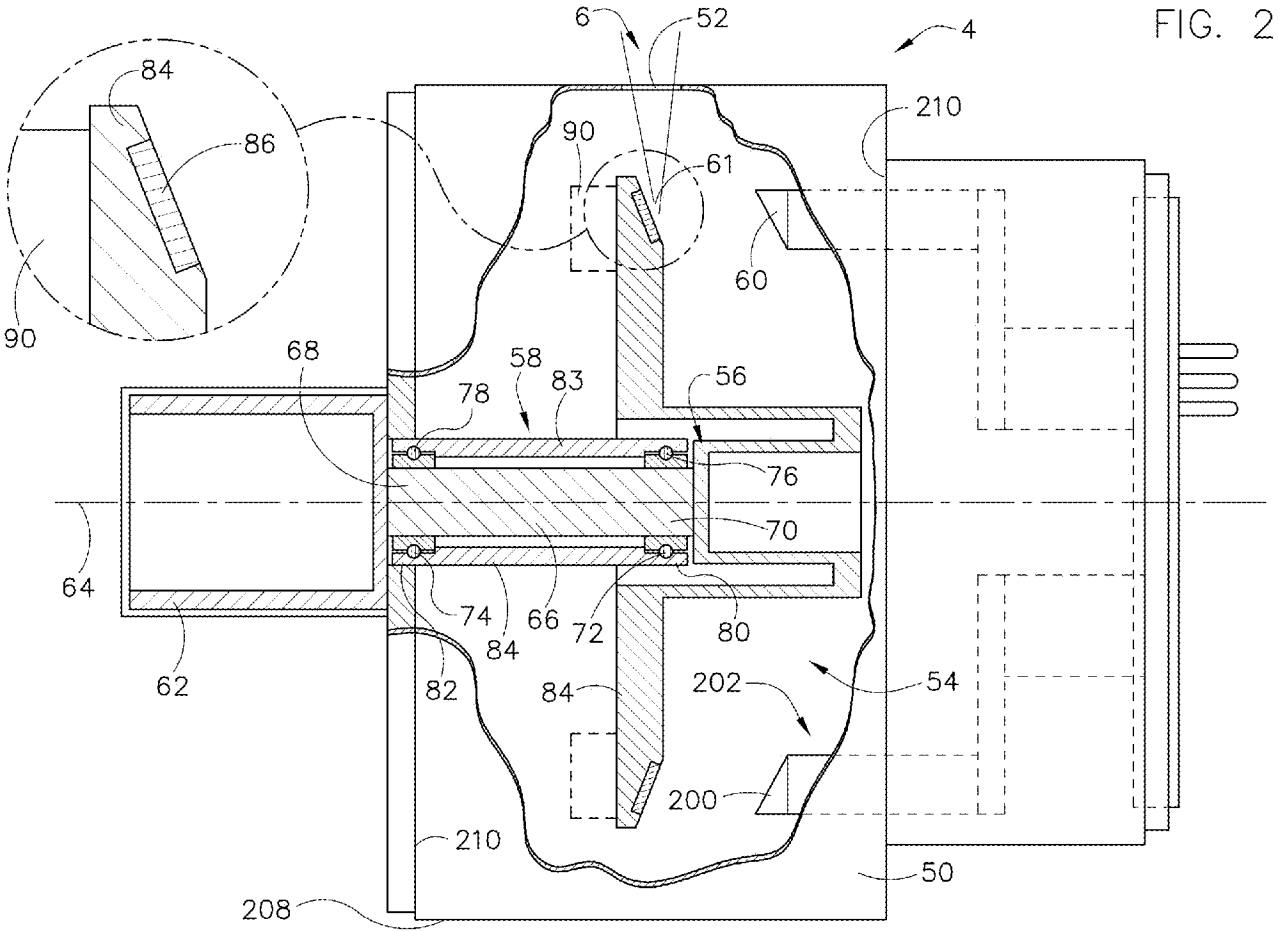
FIG. 2 illustrates a cross-sectional view of an x-ray tube that can benefit from incorporation of an embodiment of the invention.

FIG. 2 illustrates a cross-sectional view of an x-ray tube 4 that can benefit from incorporation of an embodiment of the invention. The x-ray tube 4 includes a casing 50 having a radiation emission passage 52 formed therein. The casing 50 encloses a vacuum 54 and houses an anode or target 56, a bearing assembly 58, a cathode 60, and a rotor 62. X-rays 6 are produced when high-speed electrons from a primary electron beam are suddenly decelerated when directed from the cathode 60 to the target 56 via a potential difference therebetween. In high voltage CT applications, the potential difference between the cathode 60 and target 56 may be, for example, 60 thousand volts or more. In other applications, the potential difference may be lower. The electrons impact a material layer or target focal track 86 at a focal spot or point 61 and x-rays 6 emit therefrom. The point of impact at focal point 61 is typically referred to in the industry as the focal spot. The x-rays 6 emit through the radiation emission passage 52 toward a detector array, such as detector 10 of FIG. 1. In high voltage CT applications, to avoid overheating the target 56 from the electrons, the target 56 is rotated at a high rate of speed about a centerline 64 at, for example, 90-250 Hz. In lower voltage applications, the target 56 may remain stationary.

Bearing assembly 58 includes a center shaft 66 attached to rotor 62 at first end 68 and attached to target 56 at second end 70. A front inner race 72 and a rear inner race 74 rollingly engage a plurality of front balls 76 and a plurality of rear balls 78, respectively. Bearing assembly 58 also includes a front outer race 80 and a rear outer race 82 configured to rollingly engage and position, respectively, the plurality of front balls 76 and the plurality of rear balls 78. Bearing assembly 58 includes a stem 83 which is supported by the x-ray tube 12. A stator (not shown) is positioned radially external to and drives rotor 62, which rotationally drives target 56. While FIG. 2 depicts a rotatable target 56, it is also contemplated that target 56 may be configured to remain stationary during an imaging application. The target 56 includes a target substrate 84, having target track 86 therein. Optionally, a heat storage medium 90, such as graphite, may be used to sink and/or dissipate heat built-up near the target track 86. Typically a target assembly of x-ray tube 4 includes at least target 84 (otherwise referred to as a target cap), focal spot 61, and graphite 90 (if present in the design). Thus, the target assembly may be simply an all metal disk (without graphite 90) or the target assembly may include graphite 90 to provide additional heat storage within the assembly.

According to the invention, target 84 includes a cavity proximate the focal spot into which a foam material is positioned. In one embodiment the foam material is pyrolitic graphite or carbon developed at Oak Ridge National Laboratory (ORNL). The graphite foam is a dimensionally stable material having an expansion coefficient of approximately 4 ppm/° C. It has a porosity of approximately 75% and is an open-cell structure formed by aligned ligaments that interconnect to form a continuous thermally conductive structure. The pores vary in size but in known embodiments range from approximately 60 microns to 325 microns in diameter. Thermal conductivity of the ligaments is approximately 1700 W/m-K and the ligaments are typically connected at nodes which themselves are also highly thermally conductive, thus resulting in a continuous high thermal conductivity path and a bulk thermal conductivity of approximately 200-320 W/m-K. Typically the foam ligaments have a direction associated therewith that cause the thermal conductivity and other properties to have directional characteristics. Thus, thermal conductivity in a direction orthogonal to the primary directional path may have a factor of ½ reduction. In other words, although bulk thermal conductivity of 200-320 W/m-K may be experienced in the general direction of the ligaments, approximately half that conductivity may be experienced in the cross direction(s). As such, according to the invention, it may be desirable to directionally place the foam within the target in order to selectively conduct heat, depending on the placement of the foam with respect to the target track and other aspects of the target assembly. According to known embodiments the tensile strength is approximately 1.0 MPa and the tensile modules is 1.0 GPa. One known graphitic foam includes a mesophase pitch, which defines a phase between a crystalline and an isotropic liquid phase. Other known foams include but are not limited to silicon carbide, refractory metals, and ceramics, having high directional thermal conductivities and open cell structures as well. Further known systems for foams are petroleum based or coal based, as examples.

Figure 3:
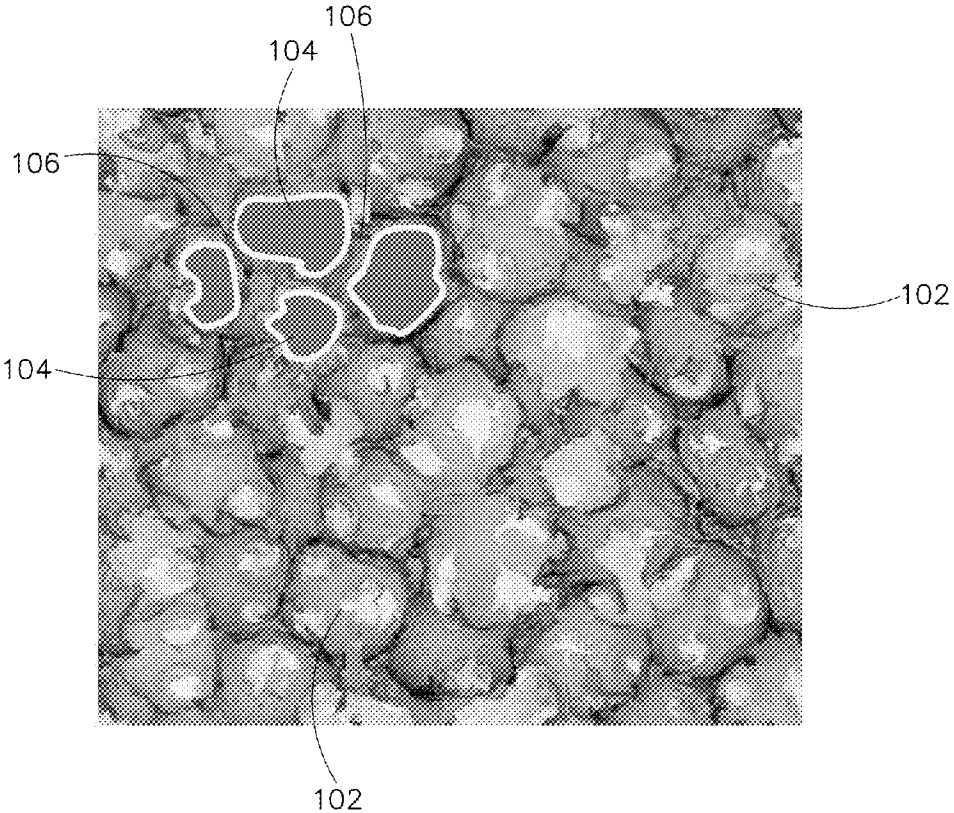
FIG. 3 illustrates a foam having an open-cell structure having an impregnate positioned in the open-cells.

Because the graphite described above is an open-cell structure, it also can be impregnated with material throughout in order to enhance heat transfer characteristics. Referring to FIG. 3, an open-cell foam 100 includes open cells 102 having an impregnate 104 positioned therein. Open-cell foam 100 typically includes many open cells 102 formed by ligaments 106, as shown. Open cells 102 continuously pass or extend throughout the structure of open-cell foam 100 and the overall structure 100 may be embedded with impregnate 104 in order to enhance heat transfer characteristics thereof. Impregnate 104 is typically applied throughout all open cells 102 and is illustrated in only a few locations in order to contrast and compare the open and unfilled cells 102 with those having impregnate 104 therein.

As stated, bulk thermal conductivity of pyrolitic graphite foam is approximately 200-320 W/m-K, thus placement of this foam within a target assembly and proximate the target track can result in reduced thermal gradients and a reduced operating temperature of the focal spot at a given power. However, thermal capacity can be increased as well by including for instance a high thermal capacity material or a phase-change material therein as, for instance, impregnate 104. For instance, if a metal or a ceramic is infiltrated into the open cell foam, it may be selected in order to pass through a phase change when passing from room temperature (solid) to high temperature (liquid) during operation of the x-ray tube. Metals and ceramics can be incorporated via a molten state, vapor deposition, sol-gel or electrochemical methods and can include, according to the invention, Cu—Ag, Cu—Mn, Cu—Ge, Cu—Si, Cu—Sn, Cu—Ti, Fe—Ge, and their alloys as well as chlorides, fluorides, hydroxides, nitrates, carbonates, vanadates, and molybdates, among others. Typically the target assembly operates at temperatures of 1100° C., or even above, thus, it is preferable that the impregnates used in the open cell experience a phase change below that temperature in order that the heat capacity of the phase change can be experienced during operation of the x-ray tube. In one embodiment the heat storage material has a liquid-solid phase-change temperature below approximately 900° C. Thus, when combining an open cell pyrolitic foam with a phase-change or slurry impregnation, both high thermal conductivity and high thermal capacity can be achieved. Further, because the foam itself is comparatively compliant and flexible, compared to the molybdenum of the target cap, the foam/impregnate can be attached to the target cap while maintaining low stress joints therein, and then hermetically capped to avoid loss of the impregnate during the life of the x-ray tube.

Figure 4:
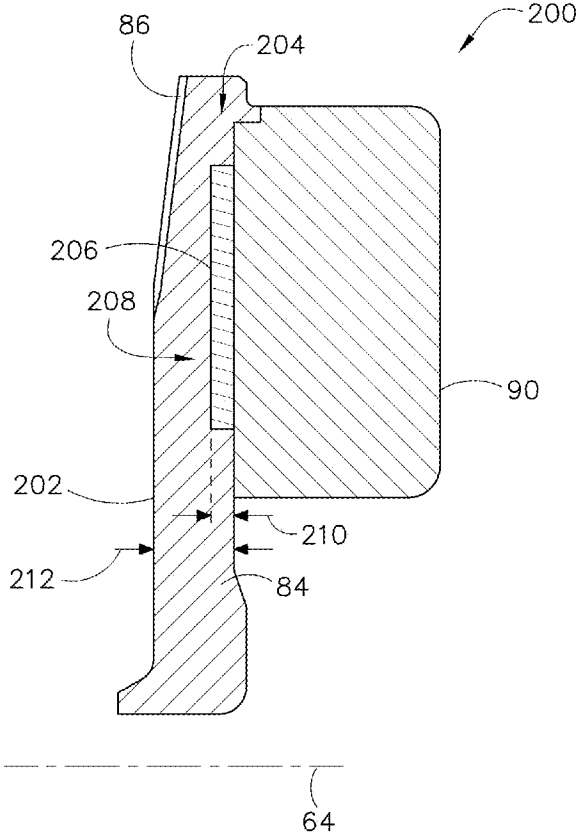

Thus, according to the invention and as illustrated in FIGS. 4-8, target assemblies are illustrated having at least a foam structure positioned therein. The illustrated embodiments may include foam, or may include a foam with impregnate as well. Referring first to FIG. 4, a target assembly 200 is illustrated having a target substrate or cap 84 as previously described. Focal track 86 is positioned on a surface that is angled with respect to a face 202 of the target assembly that is generally orthogonal to a rotational axis or the centerline 64 as previously described. Target assembly 200 includes graphite 90 and in this embodiment includes a cavity 204 having a foam 206 positioned therein. According to one embodiment, foam 206 is a carbon-based pyrolitic foam having directional thermal conductivity. As also stated, graphite foam 206 may include silicon carbide, refractory metal, or ceramic and also includes the characteristics of open-cell foam 100 described with respect to FIG. 3.

Foam 206 may also be impregnated with a heat storage material 208, consistent with that described above (impregnate 104), having a phase-change temperature below a temperature at which the target assembly operates when electrons are impinged thereon. Heat storage material 208 may include but is not limited to Cu—Ag, Cu—Mn, Cu—Ge, Cu—Si, Su—Sn, Cu—Ti, Fe—Ge, and their alloys, as well as chlorides, fluorides, hydroxides, nitrates, carbonates, vanadates, and molybdates, among others. And, as illustrated in FIG. 4, Cavity 204 having foam 206 with impregnate 208 is positioned, in this embodiment, in direct contact with graphite 90. And, although a cavity thickness 210 is illustrated as having a thickness that is noticeably less thick than that of the target cap 212, it is contemplated that the cavity thickness 210 may be nearly the same as thickness 212 so long as adequate target cap thickness is provided proximate, for instance, focal track 86, so as to avoid structural compromise proximate thereto.

Figure 5:
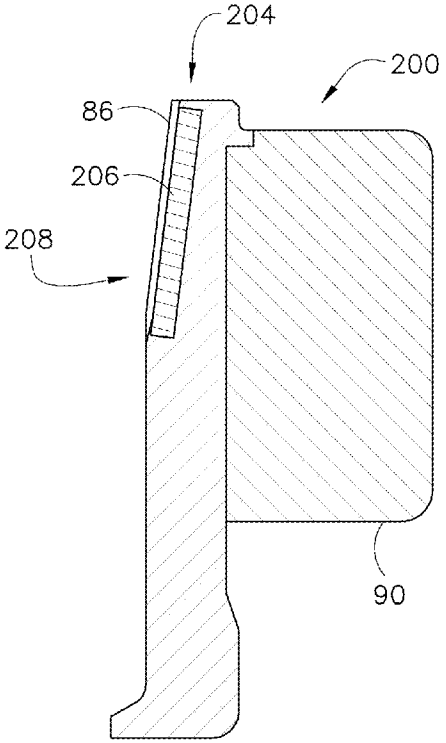
FIGS. 4-6 illustrate target assemblies for an x-ray tube in which an open cell foam is located proximate a focal track and having, optionally, an impregnate therein.
Figure 6:
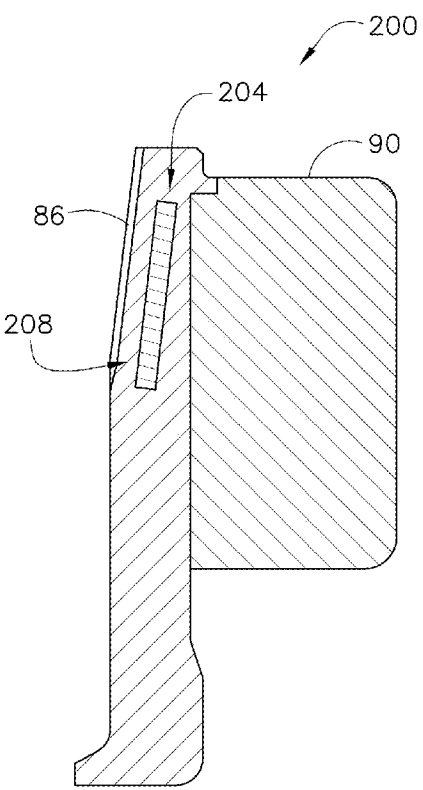

According to another embodiment, as illustrated in FIG. 5, target assembly 200 is similar to that illustrate in FIG. 4, but in this embodiment cavity 204 having foam 206 and impregnate 208 is positioned adjacent to focal track 86 and, as with that of FIG. 4, the thickness of the cavity/foam/impregnate may approach that of the target cap so long as structural integrity is achieved. Similarly, FIG. 6 illustrates cavity 204, foam 206, and impregnate 208 positioned approximately halfway between graphite 90 and focal track 86. Thus, FIGS. 4-6 illustrate embodiments in which a gradient between the focal track 86 and the graphite 90 is minimized. That is, embodiments of FIGS. 4-6 illustrate conditions in which the primary conduction path is approximately transverse to the surface of the focal track 86. As such, according to embodiments of FIGS. 4-6, foam 206 is placed having and orientation wherein the maximum bulk thermal conductivity occurs in the primary direction of conduction heat transfer. That is, the conduction path from focal track 86 to graphite 90 is generally through the thickness direction of the target cap, as illustrated in FIG. 4 as element 212. As such, in a foam having directional thermal conductivity properties of 200-320 W/m-K in one direction, it is desirable to place the foam such that higher conductivity direction is in the conduction direction and through the thickness of the target cap. More specifically, the foam 206 is positioned in order to best enhance conduction between the focal track 86 and the graphite 90, and the lesser conductive direction of the foam 206 is transverse to this direction.

Figure 8:
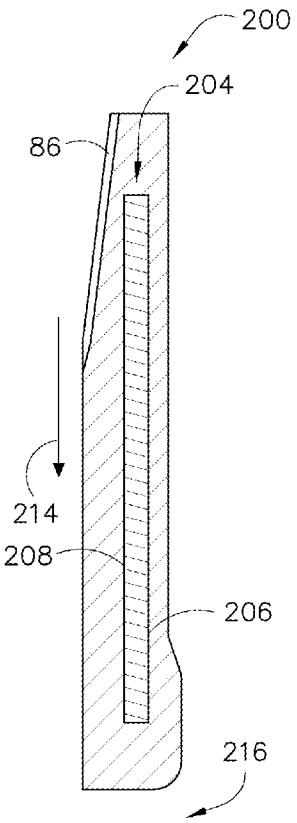
FIGS. 7-8 illustrate target assemblies for an x-ray tube in which an open cell foam is located proximate a focal track and extending inward radially to proximate a bore of the target assembly and having, optionally, an impregnate therein.
Figure 7:
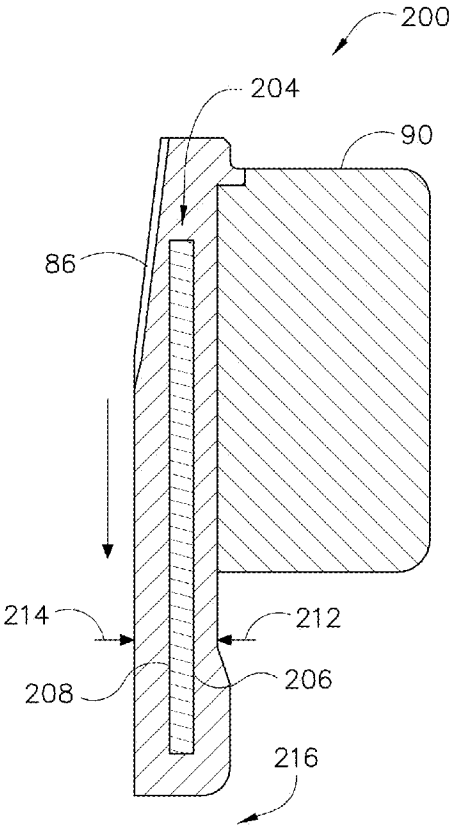

In other embodiments of the invention, foam may be positioned in order to also enhance conduction heat transfer in a radial direction of target assembly 200 as well. FIGS. 7 and 8 illustrate embodiments in which cavity 204 includes foam 206 having, as options to each embodiment, impregnate 208 positioned therein. Cavity 204 extends in a radial direction 214 and well inward of focal track 86. Cavity 204 thus extends radially from proximate focal track 86 to proximate an inner bore 216. The embodiment of FIG. 7 illustrates graphite 90 in which the heat storage capability or capacity is enhanced due to the heat storage capability of heat storage material 208 which, in one embodiment, is a phase-change material. As such, FIG. 7 illustrates target assembly 200 in which conduction heat transfer capability is enhanced both through a thickness 212 of because of the presence of foam 206 (and its enhanced thermal conductivity within ligaments, such as ligaments 106 of FIG. 3), and along radial direction 214 as well. Further, FIG. 7 includes graphite 90, however the overall heat storage capability of target assembly 200 of FIG. 7 is improved because of impregnate 208 positioned therein as well. That is, FIG. 7 illustrates an embodiment having improved heat transfer characteristics because of the improved thermal conductivity in both target thickness and radial directions, as well as because of the increased heat capacity of the impregnate within the foam/cavity that enhances the heat storage capability of the graphite that is typically included in a target assembly.

FIG. 8, on the other hand, does not include graphite as a heat storage medium as does the embodiment of FIG. 7. That is, FIG. 8 illustrates an all-metal disk or target assembly having cavity 204 in which foam 206 is positioned and in which, in one embodiment, heat storage material 208 is also placed. That is, because of the heat storage capability of heat storage material 208, the all-metal disk of FIG. 8 nevertheless includes an improved heat storage capability despite not having graphite attached thereto. As such, FIGS. 7 and 8 illustrate embodiments of the invention in which graphite may or may not be included, and in which the cavity into which thermally conductive foam is placed extends radially from the focal track to the inner bore of the target. As such, both conduction heat transfer capability as well as heat storage capability are improved due to the increased thermal conductivity of the foam and due to the increased thermal capacity of the impregnate or heat storage material placed therein.

Further, FIGS. 7 and 8 may have their respective foam 206 positioned therein with a preferred conduction direction. As stated, some foams may have directional properties or preferred directional orientation of the ligaments (such as ligaments 106 of FIG. 3). For instance, instead of randomly ordered ligaments within a foam, there may be a generally preferred direction of the ligaments. Because the ligaments have generally high thermal conductivity (approximately 1700 W/m-K in one embodiment and as mentioned above), then if the ligaments have a general orientation associated therewith, the thermal conductivity of the foam will thereby have directional properties as well. Thus, in the embodiments of FIGS. 7 and 8 it may be preferable to orient foam, in the foam embodiments in which there are directional conduction properties, in a preferred direction as well. For instance, because the embodiments of FIGS. 7 and 8 extend through a large portion of the radial direction of the target assembly 200, it may be preferable to position the foam such that its higher conductivity orientation corresponds with the radial direction of the target assembly.

Thus, in some embodiments, higher conductivity may be desired in the target thickness direction (such as FIGS. 4-6, while in other embodiments higher conductivity may be desired in the target radial direction (FIGS. 7-8). Further, the embodiments are not so limited and the invention may also include foam having its higher conductivity orientation in any direction with respect to the target assembly. For instance, depending on how the assemblies having foam/impregnate are fabricated, it may be more convenient to position the foam and add the impregnate from a preferred direction. Typically the target assembly is fabricated beginning with a target cap, into which a cavity (such as cavity 204) is formed or machined, and the foam is placed therein. The impregnate, according to one embodiment, is heated above its melt temperature and poured into the foam such that it flows within the open cells and along the ligaments. Thus, because some foams may include directional properties, it may be convenient to place the foam therein with directional properties in an orientation that is selected primarily based on the ability to impregnate the foam rather than based on its conduction orientation properties. Regardless, embodiments of the invention include improved heat transfer because of the presence of the foam and because of the presence of the impregnate therein.

Figure 9:
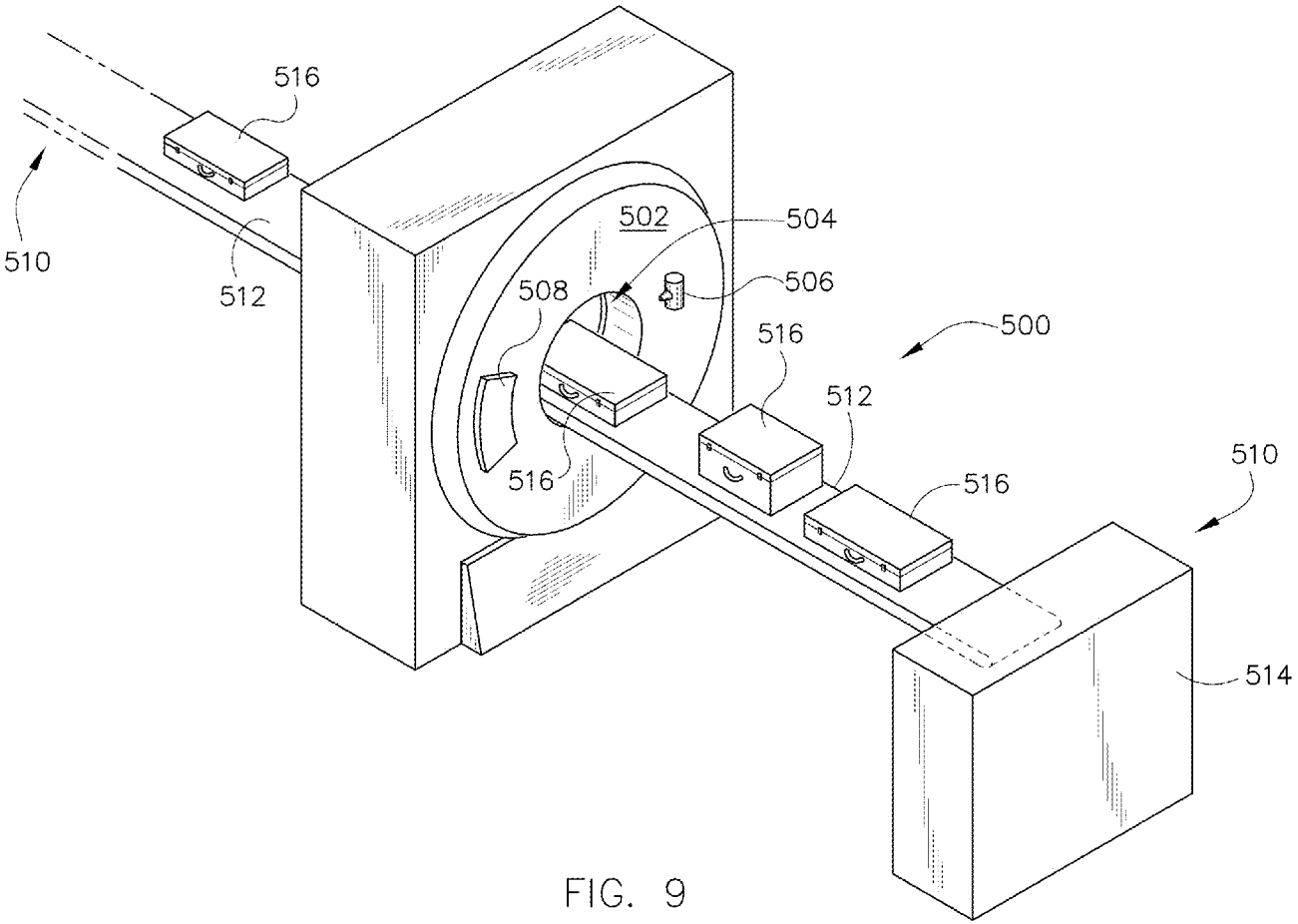
FIG. 9 is a pictorial view of an x-ray system for use with a non-invasive package inspection system incorporating embodiments of the invention.

FIG. 9 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

Therefore, according to one embodiment of the invention, an x-ray tube includes a frame enclosing a high vacuum, a cathode positioned within the enclosure, and a target assembly. The target assembly includes a target cap, a focal track material positioned on the target cap to receive electrons from the cathode, and a foam material positioned within a cavity of the target cap and positioned proximate the focal track. The x-ray tube also includes a bearing assembly attached to the frame and configured to support the target assembly.

In accordance with another embodiment of the invention, a method of fabricating a target cap for an x-ray tube target assembly includes providing a target cap having a focal track material, forming a cavity in the target cap, and positioning a foam material within the cavity.

Yet another embodiment of the invention includes an x-ray imaging system that includes a detector, positioned to receive x-rays that pass through an object and an x-ray source positioned to emit x-rays toward the object. The x-ray source includes an electron emitter and a target assembly. The target assembly includes a target cap, a focal track attached to the target cap and positioned to receive electrons from the electron emitter, a structural foam positioned within a hollow of the target cap that is positioned proximate the focal track, and a bearing assembly attached to a frame of the x-ray source and configured to support the target assembly.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:
- a frame enclosing a high vacuum;
- a cathode positioned within the enclosure;
- a target assembly comprising:
  - a target cap;
  - a focal track material positioned on the target cap to receive electrons from the cathode; and
  - a foam material positioned within a cavity of the target cap and positioned behind the focal track, the foam material having a directional thermal conductivity such that the thermal conductivity axially through the foam material is greater than the thermal conductivity radially through the foam material; and
  - a bearing assembly attached to the frame and configured to support the target assembly.

2. The x-ray tube of claim 1 wherein the foam material is carbon-based pyrolitic graphite comprising a plurality of continuous ligaments, wherein the continuous ligaments have a thermal conductivity of approximately 1700 W/m-K.

3. The x-ray tube of claim 1 wherein the foam material comprises one of carbon, silicon carbide, a refractory metal, and a ceramic.

4. The x-ray tube of claim 1 wherein the foam material comprises an open-cell foam that is impregnated with a heat storage material.

5. The x-ray tube of claim 4 wherein the heat storage material has a phase-change temperature below 900° C.

6. The x-ray tube of claim 1 wherein the foam material is in direct contact with the focal track material.

7. The x-ray tube of claim 6 wherein the foam material is in direct contact with the focal track material along an entire length of the foam.

8. The x-ray tube of claim 1 wherein the target assembly includes graphite attached to the target cap and positioned on a face of the target cap opposite a face to which the focal track material is attached.

9. The x-ray tube of claim 8 wherein the foam material is in direct contact with the graphite, with the foam material positioned between the focal track and the graphite.

10. The x-ray tube of claim 1 wherein the focal track extends radially on a focal track surface from a first target radius to a second target radius, and wherein the foam material extends radially within the cavity from proximate a bore of the target cap to between the first target radius and the second target radius.

11. The x-ray tube of claim 1 wherein the foam comprises a plurality of ligaments having a thermal conductivity along a primary directional path that is greater than a thermal conductivity in a direction orthogonal to the primary directional path, with the primary directional path parallel to a direction of the thickness of the target cap.

12. An x-ray imaging system comprising:

a detector positioned to receive x-rays that pass through an object; and an x-ray source positioned to emit x-rays toward the object, the x-ray source comprising:

an electron emitter;

a target assembly comprising:

a target cap;

a focal track attached to the target cap and positioned to receive electrons from the electron emitter; and a structural foam positioned within a hollow of the target cap that is positioned behind the focal track so as to enhance conduction through the thickness of the target cap, the structural foam comprising a plurality of continuous ligaments having a thermal conductivity greater than 1000 W/m-K, wherein the thermal conductivity of the plurality of continuous ligaments along a primary directional path is greater than the thermal conductivity of the plurality of continuous ligaments in a direction orthogonal to the primary directional path, the primary directional path being parallel to a direction of the thickness of the target cap; and a bearing assembly attached to a frame of the x-ray source and configured to support the target assembly.

13. An x-ray imaging system comprising:

a detector positioned to receive x-rays that pass through an object; and an x-ray source positioned to emit x-rays toward the object, the x-ray source comprising:

an electron emitter;

a target assembly comprising:

a target cap;

a focal track attached to the target cap and positioned to receive electrons from the electron emitter; and a structural foam positioned within a hollow of the target cap that is positioned behind the focal track so as to enhance conduction through the thickness of the target cap, the structural foam comprising an open-cell foam that is impregnated with a heat storage material, the open cell foam comprising a plurality of ligaments having a thermal conductivity along a primary directional path that is greater than a thermal conductivity in a direction orthogonal to the primary directional path, the primary directional path being parallel to a direction of the thickness of the target cap; and a bearing assembly attached to a frame of the x-ray source and configured to support the target assembly.

14. The x-ray imaging system of claim 13 wherein the heat storage material has a phase-change temperature below 900° C.

15. An x-ray tube comprising:

a frame enclosing a high vacuum;

a cathode positioned within the enclosure;

a target assembly comprising:

a target cap;

a focal track material positioned on the target cap to receive electrons from the cathode; and a foam material positioned within a cavity of the target cap, the foam material comprising a plurality of ligaments having a thermal conductivity along a primary directional path that is greater than a thermal conductivity in a direction orthogonal to the primary directional path, the primary directional path being parallel to a radial direction of the target cap; and a bearing assembly attached to the frame and configured to support the target assembly.

* * * * *